US005487706A

United States Patent [19]

Wilk

[11] Patent Number: 5,487,706

[45] **Date of Patent: * Jan. 30, 1996**

[54] ENTERTAINMENT SYSTEM AND ASSOCIATED METHOD

[76] Inventor: Peter J. Wilk, 185 W. End Avenue, New York, N.Y. 10023

[ * ] Notice: The portion of the term of this patent subsequent to Apr. 19, 2011, has been disclaimed.

[21] Appl. No.: 221,481

[22] Filed: Apr. 1, 1994

Related U.S. Application Data

[63] Continuation-in-part of Ser. No. 943,392, Sep. 10, 1992, Pat. No. 5,304,096.

[51] Int. Cl.[6] ..... A63H 13/16

[52] U.S. Cl. ..... 472/54; 472/137

[58] Field of Search ..... 472/521, 51, 52, 472/56, 134, 137; 40/412, 214; 446/222, 223, 224

[56] References Cited

U.S. PATENT DOCUMENTS

| | | | |
|---|---|---|---|
| 2,588,146 | 2/1950 | Miller | 472/51 |
| 4,786,048 | 11/1988 | Lahti et al. | 472/51 X |
| 4,903,424 | 2/1990 | Satoh et al. | 472/137 X |
| 4,903,958 | 2/1990 | DiCarlo et al. | 472/521 |
| 4,946,745 | 8/1990 | Kempa | 472/137 X |
| 5,073,140 | 12/1991 | Lebensfeld et al. | 446/297 |
| 5,234,726 | 8/1993 | Dahan | 428/9 |

*Primary Examiner*—Carl D. Friedman
*Assistant Examiner*—Kien T. Nguyen
*Attorney, Agent, or Firm*—R. Neil Sudol; Henry D. Coleman

[57] ABSTRACT

An entertainment system comprises a housing, a first ejection mechanism in the housing for ejecting a first entertainment device from the housing, a second ejection mechanism in the housing for ejecting a second entertainment device from the housing, and a control unit operatively connected to the first ejection mechanism and the second ejection mechanism for sequencing the operation of the first ejection mechanism and the second ejection mechanism. Upon lapse of a predetermined interval after ejection of the first entertainment device such as confetti or streamers from the housing, a second entertainment device such as sparklers or fireworks spinners is automatically ejected from the housing. Predetermined sound effects such as music may be generated in a predetermined synchrony with the ejection of the entertainment devices.

24 Claims, 2 Drawing Sheets

ENTERTAINMENT SYSTEM AND ASSOCIATED METHOD

This application is a continuation-in-part of application Ser. No. 07/943,392 filed Sep. 10, 1992, now U.S. Pat. No. 5,304,096.

BACKGROUND OF THE INVENTION

This invention relates to a system for providing entertainment. This invention also provides a method for entertaining.

Certain occasions in life are traditionally celebrated with noise and the throwing of confetti, rice, streamers, etc. Such occasions include the New Year, of course, but also include other, less grand occasions such as birthdays. On such relatively private occasions, it would be desirable to provide a celebration which would be difficult, if not impossible, to adequately prepare. In contrast to the grander, more public occasions, there are a limited number of people present. Sometimes such people are children and others who are incapable of contributing to a synchronized celebration but who would greatly enjoy a celebration of noise and controlled mess making.

OBJECTS OF THE INVENTION

An object of the present invention is to provide an entertainment system and/or an associated method.

Another object of the present invention is to provide an entertainment device which is self-contained and disposable.

Another, more particular, object of the present invention is to provide such an entertainment device which throws objects into the air in a celebration type action.

A further particular object of the present invention is to provide such a device which is preprogrammed to deliver or eject into the air a sequence of entertainment devices.

These and other objects of the invention will be apparent from the descriptions and illustrations provided herein.

SUMMARY OF THE INVENTION

An entertainment system comprises, in accordance with the present invention, a housing, a first ejection mechanism in the housing for ejecting a first entertainment device from the housing, a second ejection mechanism in the housing for ejecting a second entertainment device from the housing, and a control unit operatively connected to the first ejection mechanism and the second ejection mechanism for sequencing the operation of the first ejection mechanism and the second ejection mechanism. Generally, the entertainment devices are different from one another and at least one of the entertainment devices includes a pair of balloons interconnected by and supporting a banner with a message. The message may include alphanumeric representations and/or a graphic depiction. For example, the banner may include the words "Happy Birthday, John."

Pursuant to another feature of the present invention, the system further comprises an audio generator disposed in the housing and operatively connected to the control unit for generating predetermined sounds, e.g., music, in response to signals from the control means.

Pursuant to a further feature of the present invention, the other entertainment device is a streamer or a predetermined amount of confetti. Alternatively, or additionally, the other entertainment device is a fireworks device. In that event, the system further comprises an ignition disposed in the housing and operatively connected to the fireworks device for initiating oxidation of combustible materials in the fireworks device.

Where an entertainment device is a streamer or confetti, the device is ejected completely away from the housing. Where the device is firworks, such as a sparkler or a spinner, the device remains attached to the housing.

A manual activator such as a pushbutton may be mounted to the housing and operatively connected to the control unit for initiating sequencing operations by the control unit.

Generally, the housing is placed in a desired location, such as on a ground surface or a table top. When the audience is ready, the pushbutton on the housing is pressed to activate the control unit, thereby initiating a preprogrammed sequence. In more expensive versions of the entertainment system, a keyboard may be provided for enabling a user to select a sequence of activation of the different entertainment devices.

The system may include a valve and a storage cylinder connected to the balloons for pressurizing the balloons with helium gas.

A method for providing an entertainment comprises, in accordance with the present invention, the steps of (a) providing a housing, (b) automatically ejecting a first entertainment device from the housing, and (c) automatically ejecting a second entertainment device from the housing upon lapse of a predetermined interval after ejection of said first entertainment device. As noted above, the entertainment devices are different from one another and one of the device includes a pair of balloons interconnected by and carrying a banner with a message. The method further includes the step of elevating the balloons and the banner above the housing.

It is contemplated that the elevation of the balloons occurs in response to a pressurization of the balloons with helium gas. The balloons may be previously filled with gas. In that case, a holder or locking mechanism is released to enable the floating of the balloons. Alternatively, the housing may contain a valve and a storage cylinder connected to the balloons for pressurizing the balloons with helium gas. In that case, the balloons are filled on site, during the entertainment process.

According to another feature of the present invention, the method further comprises the step of generating predetermined sounds such as musical notes and cords in a predetermined synchrony with the ejection of the first entertainment device and the second entertainment device.

More specifically, one or more entertainment devices is completely ejected away from the housing or box during the preprogrammed entertainment sequence. Such entertainment devices may include streamers and/or confetti. Alternatively or additionally, one or more entertainment devices may be only partially ejected from the housing, in that they remain attached to the housing upon ejection. Such devices include fireworks such as spinners and sparklers which are advantageously held by the housing for safety reasons.

The balloons may be connected to the housing by tethers, to limit the elevation of the balloons above the housing. Alternatively, once released, the balloons may be free to float upwardly until arrested by some obstruction, such as a roof.

Where a fireworks device is ejected from the housing, the method further comprises the step of initiating oxidation of combustible materials in the fireworks device.

According to another feature of the present invention, a graphic representation such as a clown face or an alphanumeric representation such as a birthday wish is included in the message on the banner. The balloons are perhaps best ejected at the termination of the entertainment program, for example, during a finale wherein several different kinds of entertainment devices are ejected and sounds effects are orchestrated together.

An entertainment system and associated method in accordance with the present invention provides a party-like celebration in a box. Different entertainment devices such as confetti and sparklers are ejected in a preprogrammed sequence, optionally together with the playing of a musical program, to provide a diversion to children and adults on special occasions.

An entertainment system in accordance with the present invention is self-contained and includes everything needed in one package. It is not necessary to purchase bags of confetti and streamers and fireworks separately. Nothing is left over after the entertainment or celebration is completed. The entire box may be discarded.

DETAILED DESCRIPTION

Figure 1A:
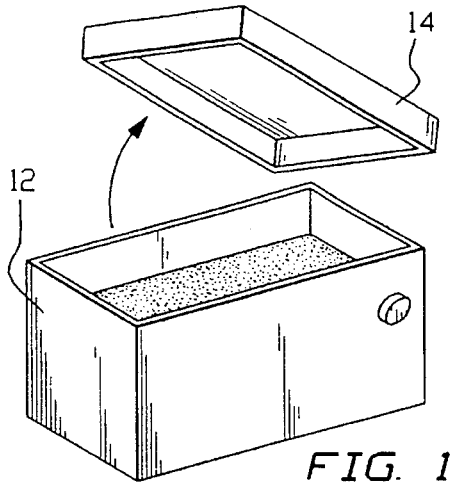
FIGS. 1A–1F are schematic perspective views showing a sequence of consecutive stages in an automatic entertainment in accordance with the present invention.

As illustrated in FIG. 1A, an entertainment housing or box 12 has arrived upon order from a central mailing facility. A lid 14 is removed and the box is placed on a table top, out of reach of young children. Everyone is instructed to stay a minimum pre-established distance (three or four feet) from the entertainment box 12.

Upon the pressing of an activation pushbutton or switch (FIGS. 1B and 2) on box 12, a plurality of entertainment devices are activated in a preprogrammed sequence, depicted in an exemplary embodiment in FIGS. 1B–1F.

Figure 1B:
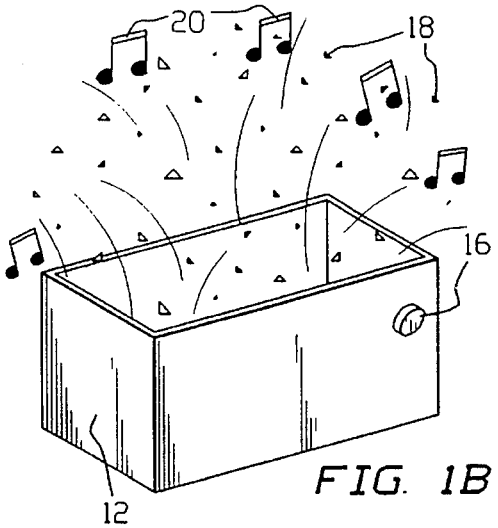
Figure 1C:
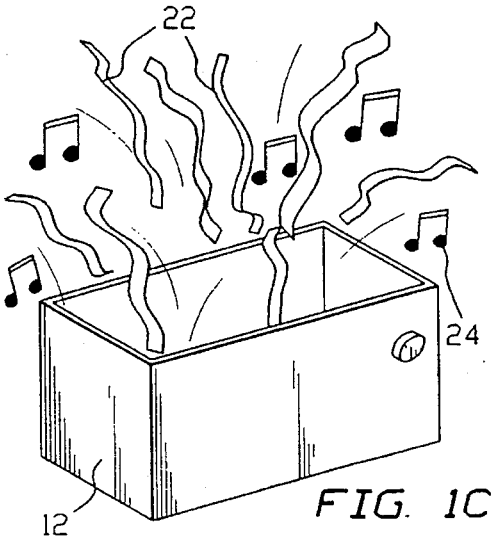
Figure 1D:
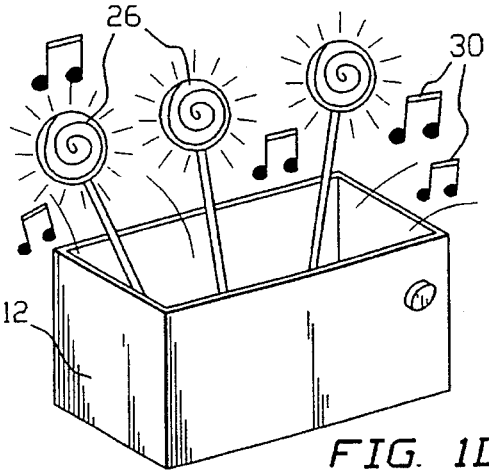
Figure 1E:
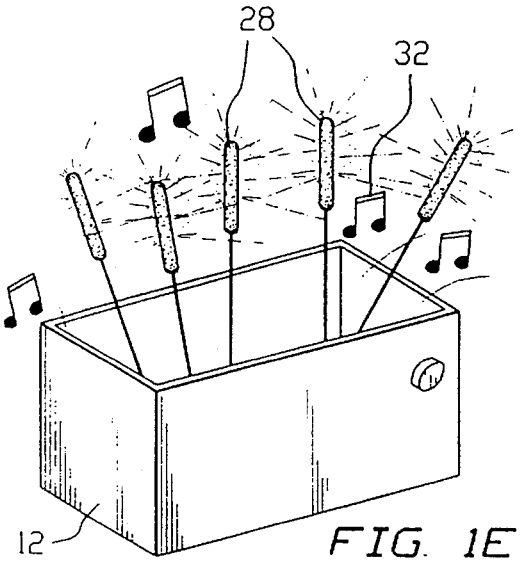
Figure 1F:
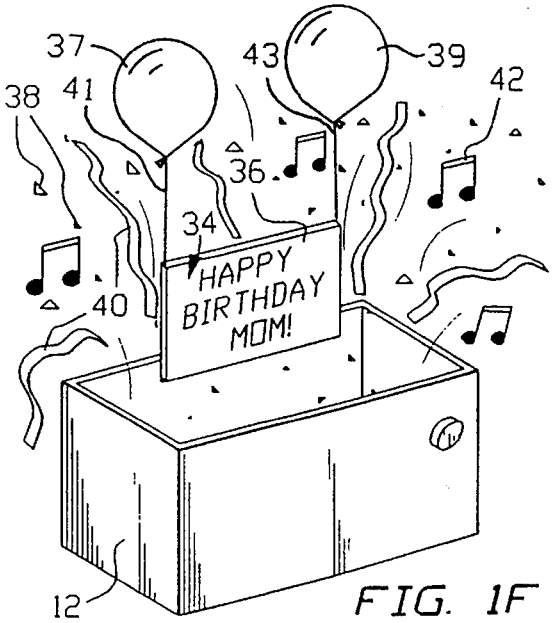

As schematically depicted in FIG. 1B, confetti 18 is ejected from the opened upper side of box 12 while musical notes 20 or other sound effects are generated inside box 12. In a subsequent step shown in FIG. 1C, streamers 22 are ejected from the upper side of box 12. Further musical notes 24 are played or generated during the time that streamers 22 are flying from the top of box 12. Upon the ejection of streamers 22, one or more fireworks such as spinners 26 (FIG. 1D) and/or sparklers 28 (FIG. 1E) appear above box 12. Musical notes 30 and/or 32 continue to be heard from box 12. Finally, a graphic or alphanumeric representation 34 on a banner or sign 36 is ejected from box 12 during a finale sequence illustrated in FIG. 1F. Other entertainment devices (e.g., more confetti 38 and streamers 40) are ejected from box 12 during the finale. The sound effects 42 also change to express a heightened celebration.

Banner 36 is a light-weight flexible sheet which is carried aloft, upwardly away from box 12, by a pair of lighter-than-air (e.g., helium filled) balloons 37 and 39. Banner 36 is linked to balloons 37 and 39 via strings 41 and 43.

Balloons 37 and 39 may be connected to box 12 by tethers 45 and 47, to limit the elevation of the balloons above the box. Alternatively, once released, balloons 37 and 39 may be free to float upwardly until arrested by some obstruction, such as a roof.

Balloons 37 and 39 are elevated in response to a pressurization of the balloons with a lighter-than-air gas such as helium gas. Balloons 37 and 39 may be previously filled with gas and stored in an inflated state in box 12. In that case, a holder or locking mechanism is released to enable the floating of the balloons. Alternatively, box 12 may contain a valve and a storage cylinder connected to the balloons for pressurizing the balloons with helium gas. In that case, the balloons are filled on site, during the entertainment process.

Figure 2:
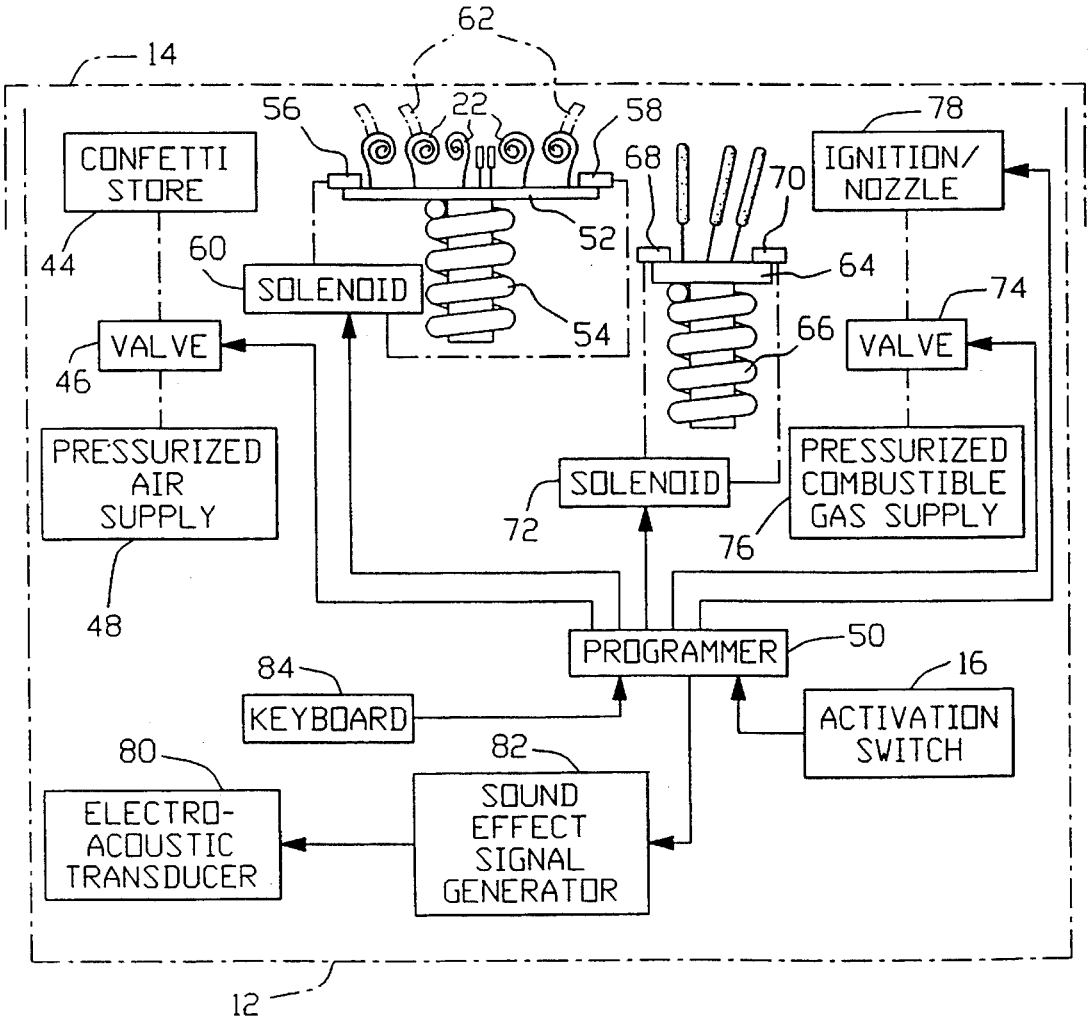
FIG. 2 is a block diagram illustrating functional components of, an entertainment box shown in operation in FIGS. 1A–1F.

As illustrated in FIG. 2, box 12 contains at least one confetti store 44 for holding confetti particles 18 and 38. Store 44 is connected to a source of pressurized air 48 via a valve/nozzle 46 which is opened in response to signals from a programmer 50, thereby jetting confetti particles 18 or 38 into the air above box 12. Streamers 22 or 40 are thrown from box 12 by a platform 52 which is rapidly moved in an upward direction by a compressed helical spring 54 upon the release of locking elements 56 and 58 by a solenoid(s) 60. Solenoid 60 is energized by programmer 50 at a predetermined time during a preprogrammed entertainment sequence. Rails or tracks 62 may be provided in box 12 for guiding streamers 22 or 40 along predefined trajectories relative to box 12.

Sparklers 28 are attached to a platform 64 which is shifted by a compressed helical spring 66 from a storage position inside box 12 into a operative position wherein sparklers 28 extend outside of box 12. Platform 64 is locked in the storage position by elements 68 and 70 which are actuated by a solenoid(s) 72 under the control of programmer 50 at a predetermined point during an entertainment sequence.

Prior to an ejection of sparklers 28, programmer 50 opens a valve 74 which enables a flow of combustible gas from a pressurized source 76 to an ignition nozzle(s) 78. Programmer 50 energizes an ignition element (not separately illustrated) of nozzle 78 at a pre-established time to generate a jet of burning gas which is directed by nozzle(s) 78 at the free ends of sparklers 28 to ignite the sparklers prior to the ejection thereof from box 12.

Spinners 26 are ignited and ejected by components (not illustrated) similar to those described above with reference to sparklers 28.

As further illustrated in FIG. 2, box 12 contains an electroacoustic transducer or speaker 80 which is connected to a sound effect signal generator 82 in turn coupled to programmer 50. In response to signals from programmer 50, signal generator 82 produces an acoustic frequency electrical signal for inducing speaker 80 to generate preprogrammed sound effects such as musical notes 20, 24, 30, 32, 42.

A keyboard 84 may be provided on housing 12 for enabling a user to select different preprogrammed entertainment sequences and different kinds of sound effects. For example, pressing one button of keyboard 84 may elicit a birthday sequence, with a "Happy Birthday" message 34 on banner or sign 36 and a "Happy Birthday" song from signal generator 82, while pressing another button results in a New Year's sequence, with New Year sound effects.

Balloons 37 and 39 are elevated in response to a pressurization of the balloons with a lighter-than-air gas such as helium gas. Balloons 37 and 39 may be previously filled with gas and stored in an inflated state in box 12. In that case, a holder or locking mechanism is released to enable the floating of the balloons. Alternatively, as illustrated in FIG. 2, box 12 may contain a valve 86 and a pressurized cylinder or reservoir 88 connected to balloons 37 and 39 for pressurizing the balloons with helium gas. Programmer 50 is operatively connected to valve 86 for operating the valve to so that pressurized cylinder or reservoir 88 temporarily communicates with the balloons to deliver pressurized helium gas thereto for purposes of inflating the balloons. Upon inflation of balloons 37 and 39, programmer 50 activates a clip applicator 90 which closes the balloons by piching shut their necks 92 with respective clamps 94. It is to be understood that many techniques are available for closing the balloons 37 and 39 upon a filling thereof with helium. For example, necks 94 may be sealed by heat or ultrasonic bonding. Heat may be applied via a resistive element while ultrasonic bonding requires an ultrasonic frequency generator and a piezoelectric transducer.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. An entertainment system comprising:

a housing;

first ejection means in said housing for ejecting a first entertainment device from said housing;

second ejection means in said housing for ejecting a second entertainment device from said housing, said second entertainment device being different from said first entertainment device, one of said first entertainment device and said second entertainment device including a pair of balloons interconnected by and supporting a banner with a message; and control means operatively connected to said first ejection means and said second ejection means for operating said second ejection means a predetermined interval after operating said first ejection means to produce a three-dimensional entertainment display which varies over a significantly extended time period.

2. The system defined in claim 1, further comprising audio means disposed in said housing and operatively connected to said control means for generating predetermined sounds in response to signals from said control means.

3. The system defined in claim 2 wherein said sounds are musical sounds.

4. The system defined in claim 1 wherein the other of said first entertainment device and said second entertainment device is a streamer.

5. The system defined in claim 1 wherein the other of said first entertainment device and said second entertainment device is a predetermined amount of confetti.

6. The system defined in claim 1 wherein the other of said first entertainment device and said second entertainment device is a fireworks device, further comprising ignition means disposed in said housing and operatively connected to said fireworks device and said second entertainment device for initiating oxidation of combustible materials in said fireworks device.

7. The system defined in claim 1 wherein at least one of said first entertainment device and said second entertainment device is ejected completely away from said housing.

8. The system defined in claim 1 wherein at least one of said first entertainment device and said second entertainment device remains attached to said housing.

9. The system defined in claim 1 wherein said message includes a graphic representation.

10. The system defined in claim 1 wherein said message includes an alphanumeric representation.

11. The system defined in claim 1, further comprising manual activator means mounted to said housing and operatively connected to said control means for initiating sequencing operations by said control means.

12. The system defined in claim 1 wherein one of said first ejector means and said second ejector means associated with said one of said first entertainment device and said second entertainment device includes means for pressurizing said balloons with helium gas.

13. The system defined in claim 1 wherein said second ejection means is different from said first ejection means.

14. A method for providing an entertainment, comprising the steps of:

providing a housing containing first ejection means for ejecting a first entertainment device from said housing and second ejection means for ejecting a second entertainment device from said housing, said second entertainment device being different from said first entertainment device;

automatically operating said first ejection means to eject said first entertainment device from said housing; and upon lapse of a predetermined interval after ejection of said first entertainment device, automatically operating said second ejection means to eject said second entertainment device from said housing, one of said first entertainment device and said second entertainment device including a pair of balloons interconnected by and supporting a banner with a message, further comprising the step of elevating said balloons and said banner above said housing.

15. The method defined in claim 14, further comprising the step of generating predetermined sounds in a predetermined synchrony with the ejection of said first entertainment device and said second entertainment device.

16. The method defined in claim 15 wherein said sounds are musical sounds.

17. The method defined in claim 14 wherein the other of said first entertainment device and said second entertainment device is a streamer.

18. The method defined in claim 14 wherein the other of said first entertainment device and said second entertainment device is a predetermined amount of confetti.

19. The method defined in claim 14 wherein the other of said first entertainment device and said second entertainment device is a fireworks device, further comprising the step of initiating oxidation of combustible materials in said one of said first entertainment device and said second entertainment device.

20. The method defined in claim 14 wherein at least one of said first entertainment device and said second entertainment device is ejected completely away from said housing.

21. The method defined in claim 14 wherein at least one of said first entertainment device and said second entertainment device remains attached to said housing.

22. The method defined in claim 14 wherein said message includes a graphic representation.

23. The method defined in claim 14 wherein said message includes an alphanumeric representation.

24. The method defined in claim 14 wherein one of said steps of automatically operating includes the step of feeding helium gas to said balloons prior to said step of elevating, said step of elevating being implemented by virtue of said helium gas.

* * * * *